US006039193A

United States Patent [19]

Naud et al.

[11] Patent Number: 6,039,193

[45] Date of Patent: Mar. 21, 2000

[54] INTEGRATED AND AUTOMATED CONTROL OF A CRANE'S RIDER BLOCK TAGLINE SYSTEM

[75] Inventors: Steven F. Naud, Lynn Haven; Max D. Weber, Panama City Beach, both of Fla.; Lei Lani Lucero; J. Dexter Bird, III, both of Hampton, Va.; Martin D. Fink, Bethesda, Md.

[73] Assignee: The United States of America as represented by the Secretary of the Navy, Washington, D.C.

[21] Appl. No.: 09/252,244

[22] Filed: Jan. 14, 1999

[51] Int. Cl.[7] ..... B66L 13/30

[52] U.S. Cl. ..... 212/270; 212/167; 212/284; 212/286; 37/396; 340/685

[58] Field of Search ..... 212/270, 167, 212/280, 284, 276; 37/396; 340/685

[56] References Cited

U.S. PATENT DOCUMENTS

| | | | |
|---|---|---|---|
| 4,133,032 | 1/1979 | Spurling | 340/685 |
| 4,261,119 | 4/1981 | Kubo et al. | 212/286 |
| 4,370,713 | 1/1983 | McCoy et al. | 212/167 |
| 4,866,641 | 9/1989 | Nielson et al. | 340/685 |
| 5,107,997 | 4/1992 | Worsley | 212/289 |
| 5,732,835 | 3/1998 | Morita et al. | 212/278 |
| 5,918,527 | 7/1999 | Haga et al. | 91/363 R |

*Primary Examiner*—Thomas J. Brahan
*Attorney, Agent, or Firm*—Harvey A. Gilbert; Donald G. Peck

[57] ABSTRACT

A method is provided to automatically control a cranes's rider block liftline and taglines. Current position of the crane's rider block is determined in terms of its horizontal and vertical coordinates, as well as in terms of the inhaul angle of the liftline. A matrix is then generated that defines i) incremental change in the rider block's horizontal coordinate with respect to incremental change in each of the boom angle, a length of the liftline and a length of the taglines, ii) incremental change in the vertical coordinate with respect to incremental change in each of the boom angle and lengths of the liftline and taglines, and iii) incremental change in the sine of the inhaul angle with respect to incremental change in each of the boom angle and lengths of the liftline and taglines. A vector defining velocity criteria for the rider block is provided. The velocity criteria is defined in terms of horizontal motion of the rider block, vertical motion of the rider block and rate of change of the inhaul angle. The velocity criteria vector is multiplied by an inversion of the matrix to generate a control matrix that defines speed and direction of travel for the liftline and taglines. Movement of the liftline and taglines is controlled using the control matrix.

2 Claims, 3 Drawing Sheets

INTEGRATED AND AUTOMATED CONTROL OF A CRANE'S RIDER BLOCK TAGLINE SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to automated control for cranes, and more particularly to a method and system for automatically controlling a cranes's rider block liftline and taglines in order to reduce the complexity of crane operation.

BACKGROUND OF THE INVENTION

Typical cranes present the crane operator with a three degree-of-freedom manual control problem. That is, a crane operator manually controls the crane's boom angle (or luffing motion), the crane's hoist line which is connected to the crane's hook or load, and the crane's slew motion, i.e., the motion experienced by the load when the boom is swung right or left about its pivot point. However, some shipboard cranes present the operator with a five degree-of-freedom manual control problem. That is, in addition to controlling a crane's boom angle, hoist line and slew angle, the operator must also control (using foot pedals, for example) the vertical and horizontal position of a rider block. Cranes such as these are known in the art as being equipped with a rider block tagline system (RBTS).

The RBTS was originally installed on a crane to reduce the pendulation of the hoist line. Briefly, a rider block cooperates with (i.e., rides along) the crane's hoist line at a position above the crane's hook or load in order to control load pendulation. The rider block is positioned vertically by a rider block liftline passing over the boom's outboard tip and down to the rider block. The rider block is positioned horizontally by a pair of taglines that extend from the crane angularly back to the rider block. Currently, the operator must manually control the outhaul or inhaul of the liftline and taglines while simultaneously controlling the boom angle, hoist line and slew angle. The increased control complexity translates to increased training time/costs, increased chance of an error, and decreased number of capable operators as the average crane operator may never be able to master the five-degree-of freedom control problem.

SUMMARY OF THE INVENTION

Accordingly, it is an object of the present invention to provide a method and system that simplifies manual crane operation for cranes requiring motion control of boom angle, a hoist line, slew angle, a rider block liftline and rider block taglines.

Another object of the present invention is to provide a method and system that reduces a crane's five degree-of-freedom motion problem to a standard three degree-of-freedom motion problem.

Still another object of the present invention is to provide a method and system that automatically controls motion of a rider block's liftline and taglines based on manual control of the crane's boom angle and hoist line.

Other objects and advantages of the present invention will become more obvious hereinafter in the specification and drawings.

In accordance with the present invention, a method is provided to automatically control a cranes's rider block liftline and taglines. Specifically, the crane has a base with a boom extending therefrom at a point of attachment to define a boom angle with a horizontal reference. The crane is also equipped with a rider block tagline system (RBTS) in which a rider block can be adjusted vertically by a liftline and horizontally by taglines. A coordinate system having an origin at the point of attachment is defined. Current position of the rider block is determined in terms of its horizontal coordinate and vertical coordinate relative to the origin, as well as in terms of the inhaul angle of the liftline. A matrix is then generated that defines i) incremental change in the rider block's horizontal coordinate with respect to incremental change in each of the boom angle, a length of the liftline and a length of the taglines, ii) incremental change in the vertical coordinate with respect to incremental change in each of the boom angle, the length of the liftline and the length of the taglines, and iii) incremental change in the sine of the inhaul angle with respect to incremental change in each of the boom angle, the length of the liftline and the length of the taglines. A vector defining velocity criteria for the rider block is provided. The velocity criteria is defined in terms of horizontal motion of the rider block, vertical motion of the rider block and rate of change of the inhaul angle. The velocity criteria vector is multiplied by an inversion of the matrix to generate a control matrix that defines speed and direction of travel for the liftline and taglines. Movement of the liftline and taglines is controlled using the control matrix.

DETAILED DESCRIPTION OF THE INVENTION

Figure 1:
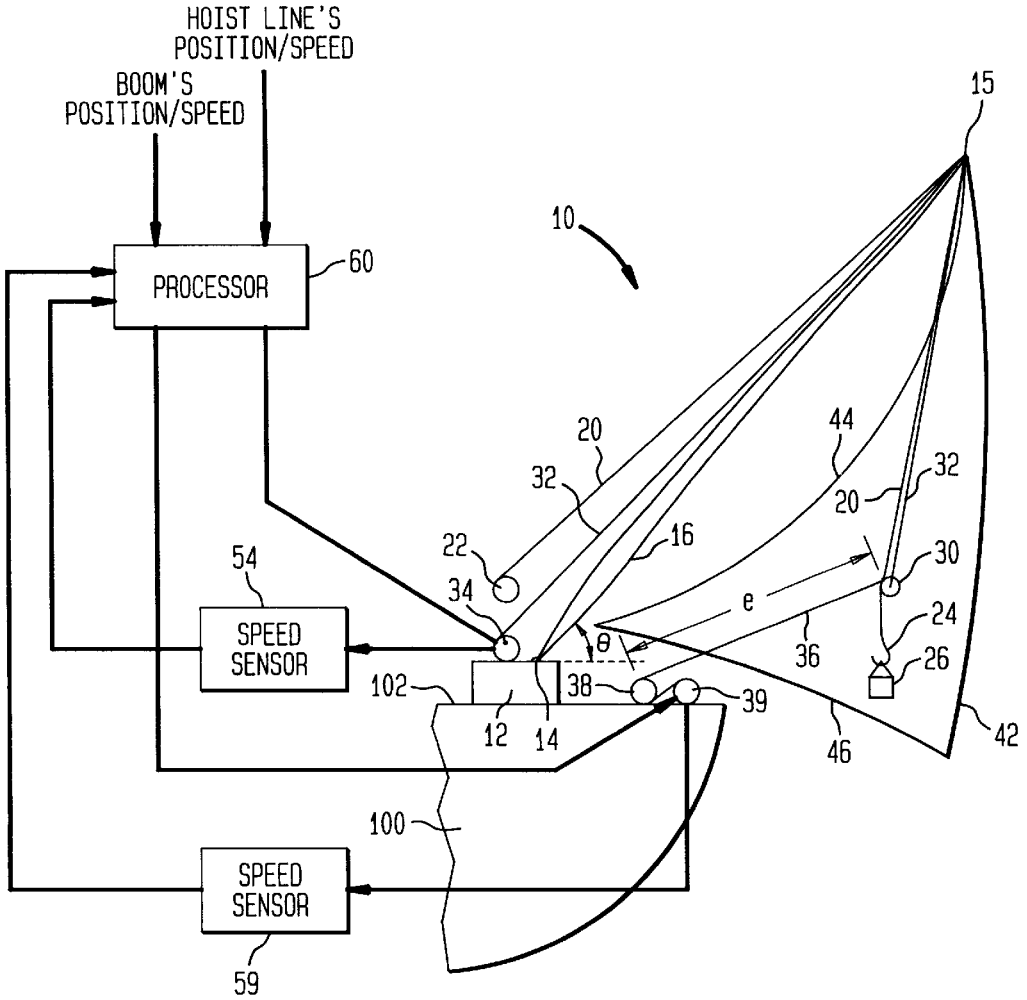
FIG. 1 is a schematic view of a shipboard crane configured for five degree-of-freedom motion and the system of the present invention for reducing crane control to three degree-of-freedom manual control.

Referring now to the drawings, and more particularly to FIG. 1, a shipboard crane having a rider block tagline system (RBTS), i.e., configured for five degree-of-freedom motion, is depicted schematically and referenced generally by numeral 10. Cranes configured in this fashion are available commercially from MacGregor Hagglunds, Sweden.

Crane 10 has a pedestal base 12 mounted, for example, on or near the edge of a deck 102 of a ship 100 which is shown in portion. Pivotally mounted to base 12 at a pivot point 14 is a boom 16. Pivot point 14 is representative of a bearing assembly as is well known in the art. The angle θ that boom 16 makes with the horizontal plane (referenced by dashed line 18) is known as the boom angle and is operator adjustable as one of the five crane motions to be controlled. A hoist line 20 extends from a winch 22 to the outboard tip 15 of boom 16 and then down to, for example, a hook 24 coupled to a load 26. The amount of hoist line 20 paid out or winched in is operator adjustable as a second of the five crane motions to be controlled. The left or right rotational swinging or slew motion of boom 16 about pivot point 14 (i.e., into or out of the page) is the third of the crane motions to be controlled. However, for purposes of the present invention, slew motion of boom 16 can be ignored.

The fourth and fifth crane motions to be controlled are related to the crane's rider block tagline system (RBTS). That is, a rider block 30 is configured and positioned to cooperate with hoist line 20 to reduce pendulation of load 26 during operation of crane 10. As is understood in the art, a variety of RBTS implementations are possible. By way of example, one such implementation is illustrated and will be explained. For example, vertical positioning of rider block 30 is the fourth crane motion and can be controlled by a rider block liftline 32 extending from a winch 34 to outboard tip 15 and then on to rider block 30 where it is attached. Horizontal positioning of rider block 30 is the fifth crane motion and can be controlled by a pair of taglines, only one of which is shown and referenced by numeral 36. Each tagline 36 attaches to rider block 30 and extends back to a sheave 38 which sits astride of pivot point 14 such that an angle is formed between the two taglines as is well understood in the art. Each tagline 36 is reeved back to a winch 39 which can be located wherever appropriate. The combination of rider block 30, rider block liftline 32, taglines 36, sheaves 38 and winches 34 and 39 is known in the art as a rider block tagline system (RBTS).

The present invention automatically controls the RBTS based on manual control of the crane's boom angle θ and hoist line 20. As a result, the present invention reduces the crane's complex, five degree-of-freedom control problem to the standard three degree-of-freedom control problem. That is, the crane operator need only focus his attention on manual control of the boom angle θ, hoist line 20 and the slew angle while the present invention automatically positions rider block 30 (via control of rider block liftline 32 and taglines 36).

In order for the RBTS to be effective, rider block 30 must remain within a feasible operating region which is defined by a quasi-triangular region bounded by three constraints or boundaries. An outer boundary 42 is the boundary at which taglines 36 are too slack to be effective. An inner boundary 44 is defined by the maximum allowed tension in either rider block liftline 32 or taglines 36. A lower boundary 46 is defined at a point where rider block liftline 32 becomes slack.

In terms of the system of the present invention, position and speed sensors 54 and 59 are coupled to winches 34 and 39, respectively, to provide both position and speed of rider block liftline 32 and taglines 36, respectively. Position of each of these lines is defined herein as a length of the line from rider block 30 back to some fixed point. For example, position of rider block liftline 32 can be defined by length "r" from outboard tip 15 of boom 16 to rider block 30. Position of each tagline 36 can be defined by length "e" from sheave 38 to rider block 30. The speed of rider block liftline 32 and taglines 36 is defined as a change in line length per unit time or dr/dt and de/dt, respectively. The output of sensors 54 and 59 are provided to a processor 60. Also provided to processor 60 are readings of boom angle θ, the speed with which boom angle θ is changing (dθ/dt), the position of hoist line 20 in terms of its paid out length, and the speed at which the length of hoist line 20 is changing. Since the inputs to processor 60 related to boom 16 and hoist line 20 are typically available from sensors included on crane 10, the sensors themselves have been omitted for clarity of illustration. Processor 60 manipulates the above described inputs thereto in accordance with the present invention, and outputs position and speed control inputs to winches 34 and 39.

Figure 2:
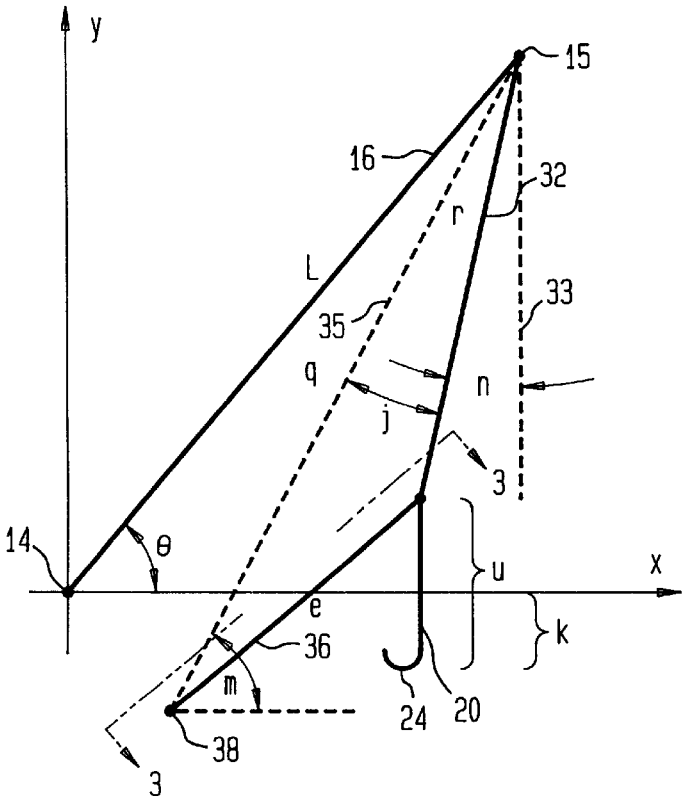
FIG. 2 is a coordinate diagram of the crane illustrating the various geometric parameters used in the present invention.
Figure 3:
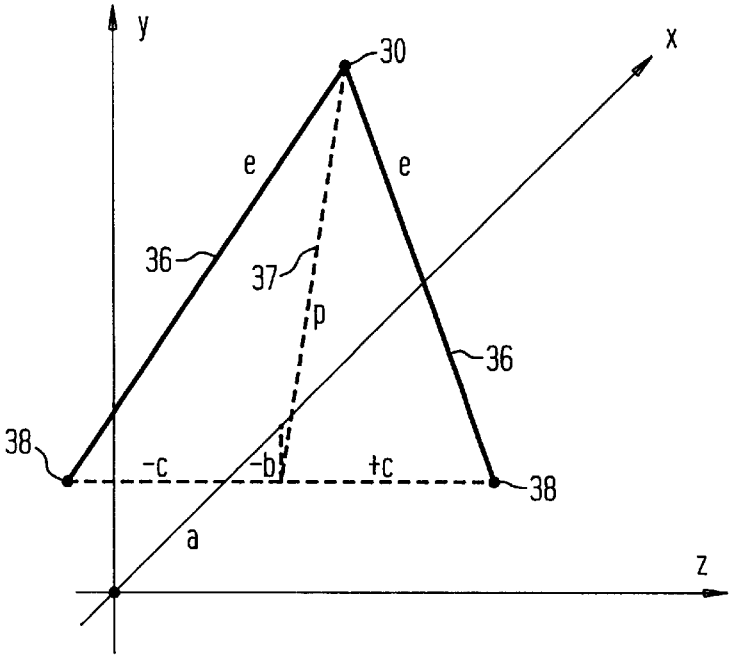
FIG. 3 is a portion of the coordinate diagram viewed along line 3—3 in FIG. 2.
Figure 4:
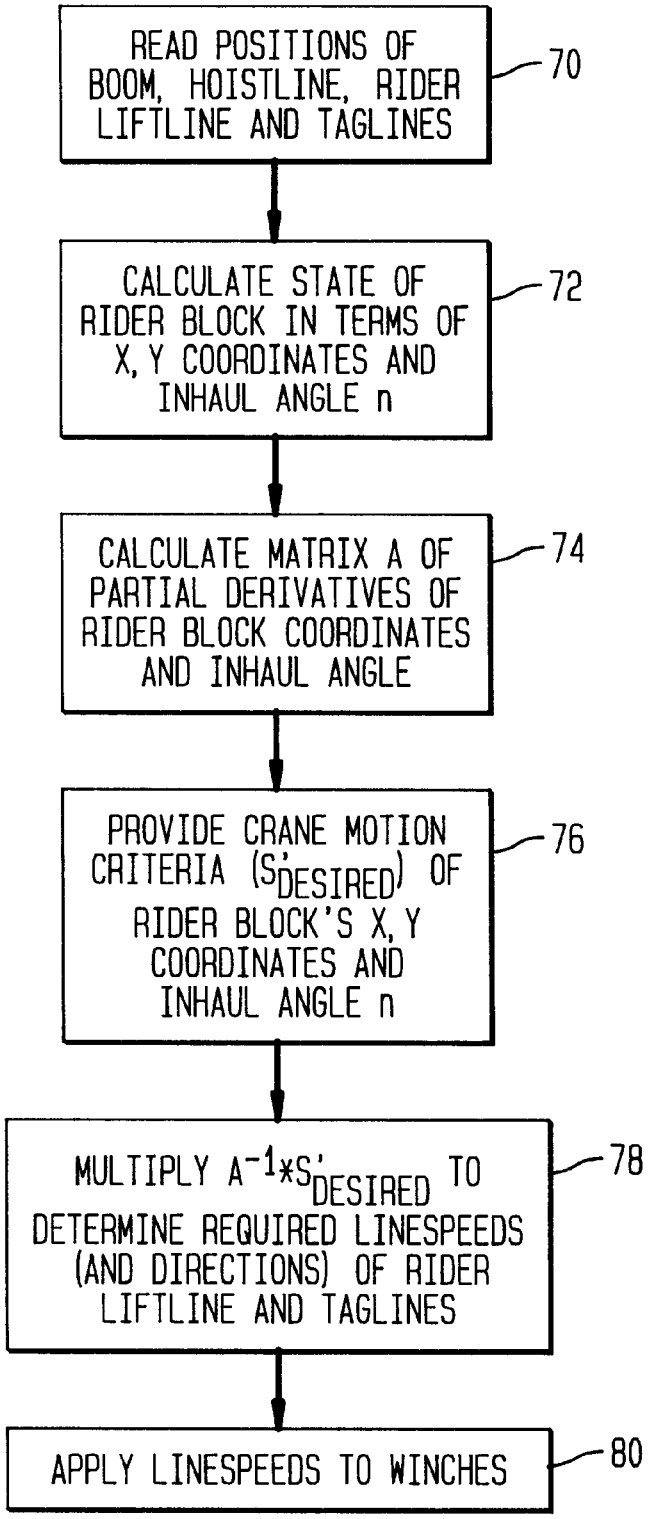
FIG. 4 is a flow chart of the method of the present invention.

Referring additionally now to FIGS. 2–4, the method of the present invention will be described. FIG. 2 is an (X,Y) coordinate diagram of crane 10 illustrating the geometric parameters used in the present invention. FIG. 3 is an (X,Y,Z) coordinate diagram illustrating a portion of the geometric parameters viewed along line 3—3 in FIG. 2. The coordinate system has an origin at pivot point 14. The coordinates of the two sheaves 38 are defined as (a,−b,±c) where the one illustrated sheave 38 is located at +c in the Z-dimension and the other sheave 38 (not illustrated in FIG. 2 for sake of clarity) is located at −c in the Z-dimension. Since taglines 36 are assumed to have the same length e, the position of rider block 30 is defined a (x,y,0). The length of boom 16 is "1". The angle between rider block liftline 32 and vertical dashed line 33 is defined as the RBTS inhaul angle "n" as is well known in the art. The length of hoist line 20 below rider block 30 is defined as length "u" and the length of hoist line 20 above or below pivot point 14 is defined as length "k".

Some other geometric parameters used in the present invention are: a length "q" of an imaginary line 35 connecting the center point of sheave 38 to outboard beam tip 15; an angle "j" formed between imaginary line 35 and rider block liftline 32; an angle "i" formed between imaginary line 35 and tagline 36; an angle "m" formed between imaginary line 35 and the horizontal; and, as illustrated in FIG. 3, a length "p" of an imaginary line 37 that bisects the angle formed between taglines 36 where $$p = \sqrt{(e^2 - c^2)} \tag{1}$$

Referring to FIG. 4, the process of the present invention begins at step 70 where positions of boom 16, hoist line 20, rider block liftline 32 and taglines 36 are used to determine the state or position of rider block 30. That is, processor 60 is supplied with sensor inputs from crane 10 that allow for the determination of boom angle θ, length r, length e and height k. Next, at step 72, standard geometrical relationships are applied to determine the state of rider block 30 in terms of its (X,Y) coordinates and inhaul angle n. Specifically, $$x=a-p\cos(m-i) \tag{2}$$

which can be expanded to $$x=a+p[\cos(m)\cos(i)+\sin(m)\sin(i)] \tag{3}$$

In a similar fashion, $$y=-b+p\sin(m-i) \tag{4}$$

which can be expanded to $$y=-b+p[\sin(m)\cos(i)+\sin(i)\cos(m)] \tag{5}$$

The inhaul angle n is defined as $$n=90-m-i \tag{6}$$

Note that in the present invention the sine of inhaul angle n will be used to simplify the analysis.

Since proper positioning of rider block 30 is a dynamic problem, just knowing the state of rider block 30 at any given moment is not enough. The motion of rider block 30 must also be considered. Crane commands governing line lengths and boom angle are in feet per second and degrees per second, respectively. Therefore, every change can be considered to be small when viewed over a small increment in time. Accordingly, the partial derivatives of x, y and sin(n) can be used to define the motion of rider block 30 when viewed with respect to boom angle θ, rider block liftline length r and tagline length e. Mathematically, the derivative of each of x, y and sin(n) is defined as a sum of partial derivatives where $$dx = \left(\frac{\delta x}{\delta\theta}\right)d\theta + \left(\frac{\delta x}{\delta r}\right)dr + \left(\frac{\delta x}{\delta e}\right)de \tag{7}$$

$$dy = \left(\frac{\delta y}{\delta\theta}\right)d\theta + \left(\frac{\delta y}{\delta r}\right)dr + \left(\frac{\delta y}{\delta e}\right)de \tag{8}$$

$$)) = \left(\frac{\delta\sin(n)}{\delta\theta}\right)d\theta + \left(\frac{\delta\sin(n)}{\delta r}\right)dr + \left(\frac{\delta si}{\delta}\right. \tag{9}$$

Using standard geometrical relationships, the partial derivatives of x and y are defined as follows:

$$\delta x/\delta\Theta = [p(\cos(m) - \sin(m)\cos(i)/\sin(i))* ((1/p - \cos(i)/q)(1/q)(qy\cos(\Theta) - qx\sin(\Theta)) - pkm(\cos(i)/\cos(m) - \sin(i)/\sin(m))] \tag{10}$$

$$x/\delta r = r/q(\sin(m)\cos(i)/\sin(i) - \cos(m) \tag{11}$$

$$\delta x/\delta e = e/p*(\cos(m)\cos(i) + \sin(m)\sin(i)) + (\cos(m) - \sin(m)\cos(i)/\sin(i))*e(1/q - \cos(i)/p)) \tag{12}$$

$$\delta y/\delta\Theta = [p(\sin(m) - \cos(m)\cos(i)/\sin(i))* ((1/p - \cos(i)/q)(1/q)(qy\cos(\Theta) - qx\sin(\Theta)) + pkm(\cos(i)/\cos(m) + \sin(i)/\cos(m))] \tag{13}$$

$$y/\delta r = -r/q(\sin(m) + \cos(m)\cos(i)/\sin(i) \tag{14}$$

$$\delta y/\delta e = e/p*(\sin(m)\cos(i) - \sin(i)\cos(m)) + (\sin(m) + \cos(m)\cos(i)/\sin(i))*e(1/q - \cos(i)/p)) \tag{15}$$

$$\delta\sin(n)/\delta\Theta = [(\cos(m) + \sin(m)\cos(j)/\sin(j))* ((1/r - \cos(j)/q)(1/q)(qy\cos(\Theta) - qx\sin(\Theta)) - \mathrm{km}(\cos(j)/\cos(m) + \sin(j)/\sin(m))] \tag{16}$$

$$\delta\sin(n)/\delta r = [(\cos(m) + \sin(m)\cos(j)/\sin(j))*((1/q) - \cos(j)/r))] \tag{17}$$

$$\delta\sin(n)/\delta e = [-(\cos(m) + \sin(m)\cos(j)/\sin(j))*(e/qr)] \tag{18}$$

Using the partial derivatives, a matrix A of partial derivatives of rider block coordinates and the inhaul angle is defined at step 74 where $$A = \begin{vmatrix} \frac{\delta x}{\delta\theta} & \frac{\delta x}{\delta r} & \frac{\delta x}{\delta e} \\ \frac{\delta y}{\delta\theta} & \frac{\delta y}{\delta r} & \frac{\delta y}{\delta e} \\ \frac{\delta\sin(n)}{\delta\theta} & \frac{\delta\sin(n)}{\delta r} & \frac{\delta\sin(n)}{\delta e} \end{vmatrix} \tag{19}$$

The state or position of rider block 30 can be written as a 3x1 matrix or vector S where $$S = \begin{vmatrix} x \\ y \\ \sin(n) \end{vmatrix} \tag{20}$$

Similarly, the crane motions affecting the position of rider block 30 can be written as a vector U where $$U = \begin{vmatrix} \theta \\ r \\ e \end{vmatrix} \tag{21}$$

The relative velocity of the (X,Y) coordinates of rider block 30 and inhaul angle n is S' which can be defined as $$S' = A\,U' \tag{22}$$

where U' is a matrix defining the speed of the mechanisms controlling boom angle θ, rider block liftline length r and tagline length e. Solving for U', $$U' = A^{-1}S' \tag{23}$$

where $A^{-1}$ represents the inversion of matrix A.

In the present invention, it is necessary to provide or define crane motion criteria in terms of a desired set of motion parameters or $S'_{DESIRED}$ at step 76. That is, $S'_{DESIRED}$ represents a desired velocity criteria for the mechanisms controlling the position of rider block 30. One such velocity criteria will be described by way of example but it is to be understood that other velocity criteria could be used. Further, an adaptive or learning-type control system could be used to update or optimize the $S'_{DESIRED}$ criteria.

A simple velocity criteria for $S'_{DESIRED}$ can be based on a level-luffing crane since most crane operators are well-schooled when it comes to controlling a level-luffing crane (i.e., a crane where height k is maintained constant as boom angle θ changes). In the present invention, if boom angle θ increases or decreases, winches 34 and 39 must be directed to adjust rider block liftline 32 and taglines 36, respectively, so that dy=0 and d(sin(n))=0 in order to operate like a level-luffing crane.

Regardless of the $S'_{DESIRED}$ criteria used/selected, $S'_{DESIRED}$ is substituted into equation (23) at step 78. As a result, a matrix U' is developed defining a desired set of linespeeds applied to winches 34 and 39 (at step 80) to control rider block liftline movement and length r, and tagline movement and length e. The sign of the linespeeds signifies a direction of line travel, i.e., winch up or payout.

The advantages of the present invention are numerous. A complex five degree-of-freedom crane can be controlled as a standard three degree-of-freedom crane. Specifically, a rider block's liftline and taglines are controlled (in terms of line speed and direction) automatically based on, for example, change in the crane's boom angle.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by letters patent of the united states is:

1. A method for automatically controlling a cranes's rider block liftline and taglines, comprising the steps of:

providing a crane having a base with a boom extending therefrom at a point of attachment to define a boom angle with a horizontal reference, said crane further being equipped with a rider block tagline system in which a rider block can be adjusted vertically by a liftline and horizontally by taglines;

defining a coordinate system having an origin at said point of attachment;

determining a current position of said rider block in terms of its horizontal coordinate and vertical coordinate relative to said origin, and in terms of an inhaul angle of said liftline;

generating a matrix that defines i) incremental change in said horizontal coordinate with respect to incremental change in each of said boom angle, a length of said liftline and a length of said taglines, ii) incremental change in said vertical coordinate with respect to incremental change in each of said boom angle, said length of said liftline and said length of said taglines, and iii) incremental change in the sine of said inhaul angle with respect to incremental change in each of said boom angle, said length of said liftline and said length of said taglines;

providing a vector defining velocity criteria for said rider block in terms of horizontal motion of said rider block, vertical motion of said rider block and rate of change of said inhaul angle;

multiplying said vector by an inversion of said matrix to generate a control matrix that defines speed and direction of travel for said liftline and said taglines; and controlling movement of said liftline and said taglines using said control matrix.

2. A method according to claim 1 wherein said velocity criteria is defined by said vertical motion and said rate of change of said inhaul angle being zero.

* * * * *